United States Patent [19]

Rogers

[11] 4,134,091

[45] Jan. 9, 1979

[54] LOW COST, HIGH EFFICIENCY RADIO FREQUENCY TRANSFORMER

[76] Inventor: Noel A. Rogers, 9121 W. 70th St., Shawnee Mission, Kans. 66204

[21] Appl. No.: 858,808

[22] Filed: Dec. 8, 1977

Related U.S. Application Data

[63] Continuation-in-part of Ser. No. 749,358, Dec. 10, 1976, abandoned.

[51] Int. Cl.[2] ..... H01F 27/08; H01F 27/30; H01F 41/02

[52] U.S. Cl. ..... 336/61; 29/605; 29/606; 336/62; 336/65; 336/175; 336/195; 336/223

[58] Field of Search ..... 336/61, 221, 62, 65, 336/173, 174, 175, 189, 190, 192, 195, 222, 223; 29/602 R, 605, 606, 607

[56] References Cited

U.S. PATENT DOCUMENTS

| | | | |
|---|---|---|---|
| 2,451,324 | 10/1948 | Dutton | 336/175 X |
| 3,197,723 | 7/1965 | Dortont | 336/195 |
| 3,614,694 | 10/1971 | Koontz | 336/195 X |

FOREIGN PATENT DOCUMENTS

| | | | |
|---|---|---|---|
| 1076844 | 3/1960 | Fed. Rep. of Germany | 336/221 |
| 308406 | 3/1929 | United Kingdom | 336/174 |

*Primary Examiner*—Thomas J. Kozma
*Attorney, Agent, or Firm*—Schmidt, Johnson, Hovey & Williams

[57] ABSTRACT

Especially simple structure for an electrical transformer device provides cost effective fabrication thereof and offers improved operating performance particularly in a radio transmitter circuit for coupling high levels of radio frequency energy from the output of a radio frequency amplifier to an antenna system. One winding of the transformer is formed from a single, unitary, tubular member arranged into a U-shaped configuration which includes a pair of spaced sets of openings therein for the two-fold purpose of allowing efficient threading of a secondary winding therewithin and to improve air cooling characteristics of the device. A second winding comprises a wire passed through the interior of the tubular member, and a number of cylindrically shaped magnetic elements are sleeved over the tubular member to enhance the mutual inductive coupling between the windings. A circuit board having a cut-out zone therethrough is especially adapted to have the transformer device mounted thereon in an essentially flat position juxtaposed over the cut-out zone to provide maximum convection and conduction cooling of the transformer and thereby significantly increase the power handling capabilities of the device.

14 Claims, 6 Drawing Figures

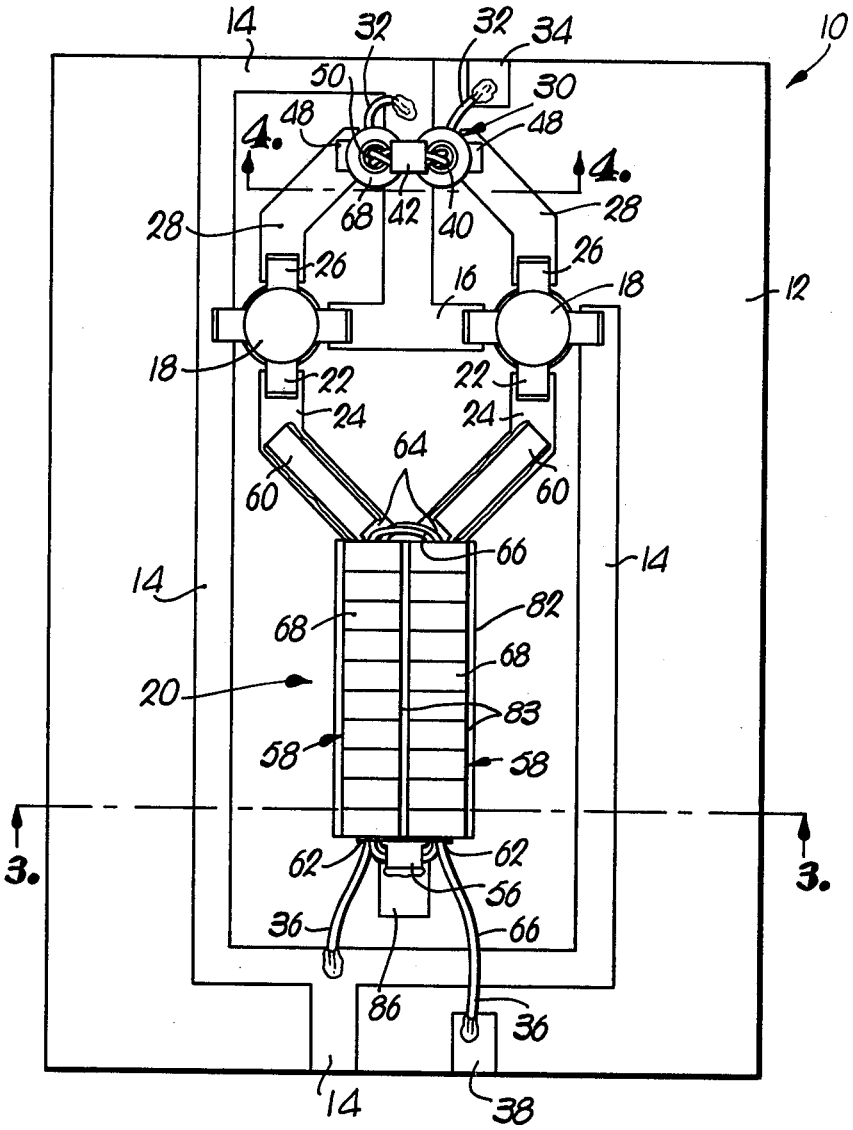
Fig. 1.
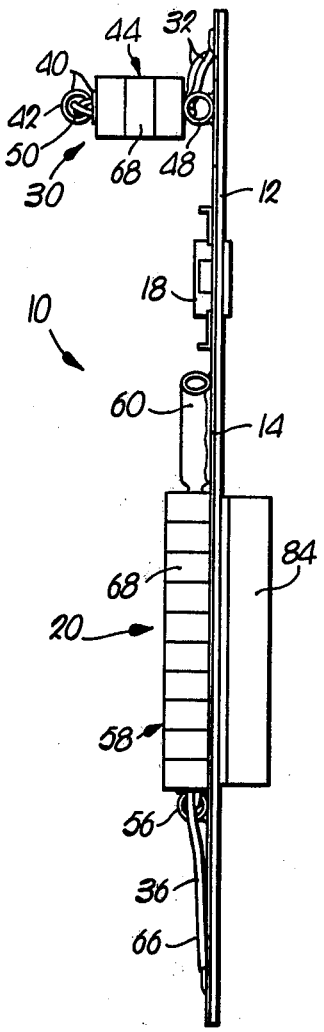
Fig. 2.
Fig. 3.
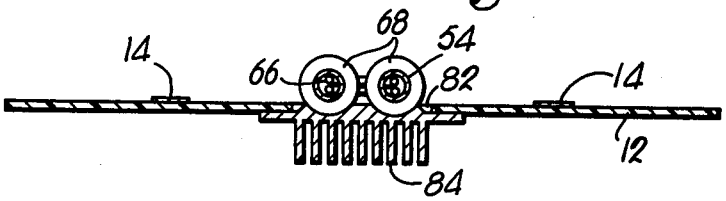
Fig. 6.
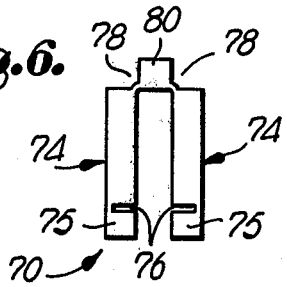
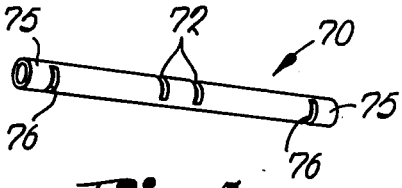
Fig. 5.
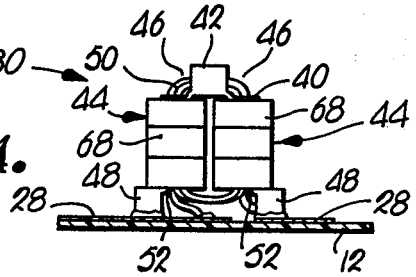
Fig. 4.

LOW COST, HIGH EFFICIENCY RADIO FREQUENCY TRANSFORMER

This is a Continuation-In-Part of application Ser. No. 749,358 filed Dec. 10, 1976, now abandoned.

BACKGROUND AND BRIEF DESCRIPTION OF THE INVENTION

The invention relates to electrical transformer circuits and related apparatus, and deals more particularly with novel improvements in the design of, and method of producing, radio frequency transformers, especially those which are employed to couple radio frequency energy from the output amplifiers of a radio transmitter to an antenna system.

Transformers are commonly employed in electrical circuitry for coupling electrical energy from one circuit to another, and are particularly selected in specific applications to perform transformations of voltage or current, as well as impedance or power matching functions between the coupled circuits. In designing such transformers for use in the circuitry of radio transmitters, key performance requirements include: especially compact size compatible with miniaturized electronic circuitry; minimization of flux leakage to avoid stray inductive coupling between adjacent circuits proximal to the transformer; high Q; and, high coupling efficiency over the broad radio frequency (RF) band of 2 to 30 megahertz.

The aforementioned performance requirements have been only partially satisfied by prior art transformer devices. For example, one known method of constructing a transformer of the so called "RF broad-band" type involves sleeving a number of hollow cylinders of ferrite material over the entire length of the brass tube. The ends of a number of such tube assemblies are then mounted parallel to each other between a pair of opposed, parallel plates of insulative material, the ends of each tube being disposed within apertures in the plates. The outer sides of each plate has a printed type circuit thereon which electrically connects selected ones of the tubes together when the ends of the tubes are soldered to adjacent printed circuit lands on the plates. An insulated conducting wire is then threaded through the interior of the open ended tubes to form "U" shaped windings. The tubes, interconnected by the printed circuitry, act as the "primary" of the transformer, while the insulated conducting wire threaded through the tubes, functions as the "secondary". A prior art transformer of the type described above is manufactured by the TRW Electronics Components Corporation and is identified in the manufacturer's applications note CT-113-71. While this prior art construction technique is suitable for some transformer applications, there are many instances when these transformers are rather inefficient in terms of their performance in relation to the physical space that they occupy, and in any event, these prior art transformers are relatively expensive to fabricate. As mentioned above, the ends of the brass tubes of the prior art construction are connected to the printed circuitry on the end plates; this connection is normally effected by soldering, however, in many high power amplifier applications, heat build-up may partially melt the solder to the extent that circuit performance is adversely affected and hence, in these particular applications the tubes must be joined by more expensive brazing processes which eliminate the melting problem.

Other known prior art includes: U.S. Pat. Nos. 3,717,808; 3,725,741; 3,961,292; French Pat. No. 1,288,166; and German Pat. No. 2,320,589. Each of these prior patents disclose transformer devices wherein the windings are coaxial in nature; coaxial transformer constructions, particularly in miniturized applications, are especially costly to manufacture since the longitudinal axes of the windings must be held in close coaxial alignment during assembly in order to produce a transformer which has satisfactory performance characteristics. More significantly however, none of the transformer designs disclosed in the above noted patents are suitable for use in miniturized radio circuitry since none of such designs would be capable of coupling high levels of energy (compared to their small relative size which would be necessitated by use in a miniturized radio circuit) without quickly overheating; heat build up within the windings of such previous transformer designs would of course, severly limit their power handling capacity. Moreover, it is often desireable, particularly in radio transmitter circuits, to mount the transformers with their longitudinal aspect closely adjacent the surface of a circuit board, in which case transformer designs of the type described in the mentioned patents (even if miniturized) would entrap substantial quantities of heat between the sides of the transformer and the circuit board thereby further reducing the power handling capacity of the transformer.

The present invention overcomes the deficiencies inherent in prior art designs by providing a transformer including a novel winding configuration which is especially effective in dissipating heat away from the transformer but yet is particularly compact in size in relation to the high power levels which it is capable of handling. According to the present invention, a single, unitary, straight length of tubing comprising an electrically conductive material such as copper or brass, is formed or "bent" into a configuration having a looped or bight portion and a pair of legs, the ends of such legs being disposed adjacent to each other. In the preferred form, the tubing is bent into a U-shaped member, whose legs are of essentially equal length, and a pair of cut-away portions providing openings are provided on each side of the looped portion adjacent the legs, there being a second set of cut-away portions providing a second set of openings respectively near the extremities of the legs. Hollow, cylindrical magnetic elements, such as ferrite or the like, are then sleeved over each leg of the tubing. An insulated conducting wire is twisted about itself as it is successively passed through the interior of the tubing a preselected number of times to form a number of coil turns which comprises one winding of the transformer, while the tubing itself is employed as a second winding. The ends of the conducting wire may be trained out through either the first or second set of openings to provide one set of winding taps for connection to one external circuit while the extremities of the tubing may be bent as desired and directly connected to a second external circuit thereby providing a second set of winding taps.

Accordingly, it is a primary object of the present invention to provide especially simple structure for a radio frequency transformer device which is highly economical to fabricate. As a corollary to the foregoing object, it is a further object to provide a novel method of constructing a transformer device which minimizes the labor needed to fabricate the same and eliminate several fabrication steps heretofore required in the production of prior art transformers of the character described above.

Another object of the invention is to provide a broadband transformer device of the type described, which completely obviates the need for solder joining the constituent portions of the transformer during fabrication thereof.

A still further object, related to the foregoing object, is to provide a broadband transformer which is highly reliable in operation and whose constituent parts are not vulnerable to the heating effect typically encountered in high power circuit applications over a broad range of radio frequencys.

Another object of the invention is to provide a broadband transformer which is physically compact in size and has superior flux coupling efficiency while using less magnetic loading material to enhance such coupling. Moreover, as a result of the invention's of superior flux coupling efficiency, the effective operating band-width of the transformer is improved.

A further significant object of the invention is to provide a broadband transformer of the type described which employs a tubular winding having a geometrical configuration which is particularly effective in dissipating heat entrapped therewithin.

A still further object of the invention is to provide a broadband transformer of the type described above whose longitudinal aspect may be mounted parallel, virtually flush with a specially adapted printed circuit board in a manner to maximize cooling of the transformer while also minimizing space requirements in the associated electronic circuit package.

Other a further objects of the invention will be made clear or become apparent in the course of the following description of preferred and alternate embodiments of the invention.

DETAILED DESCRIPTION OF THE INVENTION

In the accompanying drawing:

FIG. 1 is a plan view of a printed circuit board assembly used in a radio frequency transmitter showing the final amplifier output stage thereof, and depicting both a preferred and alternate form of the present invention;

FIG. 2 is a side elevational view of the printed circuit board assembly shown in FIG. 1;

FIG. 3 is a cross-sectional view taken along the line 3—3 in FIG. 1;

FIG. 4 is a cross-sectional view taken along the line 4—4 in FIG. 1; and

FIGS. 5 and 6 depict steps in a method for making the present invention.

Referring first to FIGS. 1 through 4, a printed circuit board (PCB) assembly 10 includes a planar, insulative board 12 having a number of circuit paths such as paths 14 and 16 imprinted thereon and selectively connected to latter discussed electrical components which are mounted on, and are physically supported by the board 12. As disclosed herein, PCB assembly 10 comprises the final power output stage of a radio frequency transmitter and includes a pair of radio frequency (RF) output amplifiers in the form of transistors 18 whose collector leads 22 are connected to the output power transformer generally designated by the numeral 20 via circuit paths 24, while the base leads 26 are connected by circuit paths 28 to the input transformer generally indicated by the numeral 30, the emitters of transistors 18 being commonly connected by circuit path 16. The primary input leads 32 of the input transformer 30 are connected as by soldering to circuit paths 14 and 34 respectively which are in turn connected with other portions of the radio transmitter circuitry (not shown). The secondary leads 36 of the output transformer 30 are connected to the circuit paths 14 and 38, which latter paths are normally in turn connected with an antenna system (not shown).

Before turning attention to the novel manner in which the transformers 20 and 30 are employed in the PCB assembly 10, it will be helpful to first provide a description of the transformers 20 and 30 which are generally quite similar in construction details. The transformer 30 comprises a single, unitary, tubular member 40 having a curved "bight" portion 42 and a pair of generally straight, parallel legs 44 projecting from the bight portion 42 whereby to form a generally U-shaped configuration. The tubular member 40 forms the secondary winding of the transformer 30 and includes a pair of cut-away portions 46 on each side of bight portion 42 between the legs 44 to form a pair of openings thereat whose significance will become clear hereinafter. The extremities 48 of the legs 44 extend laterally away from the central stretches of legs 44 and away from each other and thus provide proper spacing to allow soldering directly to the circuit paths 28 thereby electrically connecting the tubular member 40 to the PCB assembly 10 while also providing a means for mounting the same on the board 12. It will be appreciated at this point that the bight 42 is formed integral with the legs 44 and the extremities 48, thus eliminating the need for soldering or the like to connect the various portions of the winding which is formed from the unitary tubular member 40. An elongate, insulated conducting wire 50 has the opposite extremities thereof trained through the openings 52 and connected as by soldering to circuit paths 14 and 34, while the length thereof is looped through the interior of the legs 44 and bight 42 a prescribed number of times to form the desired number of coil turns of the primary winding of the transformer 30. The lengths of the wires 50 in the coil turns thereof are twisted about each other in a spiral manner, as best shown in FIGS. 1 and 2; by this feature, it has been found that the balance and uniformity of inductive coupling between the windings is significantly improved. In order to maximize inductive coupling between the primary and secondary windings, the interior diameter of tubular member 40 and the diameter of conducting wire 50 preferably should be selected such that the composite number of turns of the wire 50 completely fill the interior of the tubular member 40. Although in the preferred form the conducting wire 14 will include an insulating jacket therearound to prevent direct conduction between the wire 50 and tubular member 40, this insulative relationship could obviously be likewise achieved by suspending the turns of the wire 50 within the member 40 whereby to interpose an insulating air gap therebetween, or alternatively by sleeving a single layer of insulating material through the member 40, conforming with the interior walls of the latter. The output transformer 20 likewise includes a single, unitary, electrically conductive tubular member 54 made from copper, brass or the like and includes a bight portion 56 and a pair of straight, essentially parallel leg stretches 58 whereby to form a generally U-shaped configuration, the extremities 60 diverging away from the corresponding leg stretches 58, and away from each other. Output transformer 20 also has a pair of cut-away portions forming a pair of openings 62 on each side of the bight 56 between the leg stretches 58, there being further provided another set of cut-away portions forming the openings 64 between the leg stretches 58 and the corresponding extremities 60. A wire element 66 has the length thereof passed through the bight portion 56 and leg stretches 58 of the interior of the tubular member 54 a selected number of times to form a secondary winding, the extremities of the wire element 66 being trained through the openings 62 and connected as by soldering to the circuit paths 14 and 38. The lengths of the wire element 66 may be spirally twisted about each other if desired, as described with reference to transformer 30. In the case of both the input transformer 30 and the output transformer 20, in order to enhance the mutual inductive coupling between the respective windings, a number of cylindrical magnetic elements 68, each having a hole or aperture axially therethrough, are sleeved over the leg stretches 44 and 58 respectively of the transformers 30 and 20. The magnetic elements 68 provide magnetic means which laterally envelope stretches of the respectively associated tubular members 40 and 54 and perform the ordinary function of containing the electric flux present between the tubular members 40 and 54 and their respectively associated wire conductors 50 and 66, tending to "load" or concentrate the flux produced by the current flowing through the tubular members 40 and 54 into coupled relationship with the coil turns of the corresponding wire conductors 50 and 66. Preferably, any air gap between the interior surface of the magnetic elements 68 and the respectively associated tubular members 40 and 54 is minimized in order to maximize the loading effect provided by the magnetic material. Each of the elements 68 may be manufactured from a number of magnetic materials although it has been found that magnetically non-retentive materials, particularly those of the ferromagnetic group may be employed, ferrite being an especially suitable choice. Although a plurality of such elements 68 are depicted in the accompanying drawings, it is understood that a single one of such elements laterally enveloping a substantial length of the tubular members 40 or 54 could likewise be used with equal effectiveness. It may be readily appreciated that the magnetic elements 68 are retained on the leg stretches of the tubular members 40 and 54 by virtue of the extremities 48 and 60 respectively having been formed in a manner to angle away from the respectively associated leg stretches so as to prevent the magnetic elements 68 from sliding off the tubular members 40 and 54.

Attention is now directed also to FIGS. 5 and 6 wherein a novel method of constructing the transformers 30 and 20 is illustrated. One unique method of making the transformer blank which forms the tubular member 40 or 54, requires the provision of an essentially straight piece of electrically conductive tubing 70, of the desired length. A first pair of spaced, partial incisions 72 are made, as by sawing or the like, in one side of the tubing 70 near the longitudinal mid-point thereof, such incisions extending laterally, almost but not entirely through the tubing 70. The distance between the incisions 72 determine the eventual spacing between the leg stretches 74. A second pair of spaced, partial lateral incisions 76 are also made at each end of the tubing 70, the portions of the tubing 70 between the incisions 76 and the ends of the tubing defining the extremities 75. The second pair of incisions 76 may be made through any side of the tubing 70 with respect to the direction of the first pair of incisions 72, however, the second pair of incisions 76 are illustrated herein as being made through the opposite side the side through which the first pair of incisions 72 were made. The tubing 70 is then formed into an essentially U-shaped configuration, as shown in FIG. 6, by bending the leg stretches 74 of the same about the incisions 72, and, as a natural result of such bending, the incisions 28 are opened or partially pulled apart somewhat to provide a cut-away zone or opening 78 between the bight portion 80 and the leg stretches 74. The magnetic elements 68 are simply sleeved over the leg stretches 74, and the extremities 75 may then be formed or bent, about the incisions 76 in order to prevent the magnetic element 68 from sliding off the leg stretches 74. Finally, the insulated conducting wire 50 or 66 is then successively threaded (and twisted if desired) through the interior of the tubing 70 a prescribed number of times, the extremities of the wire conductor being selectively trained out through either the openings 78 adjacent the bight portion 80 or the openings associated with the incisions 76. It is important to note that the conducting wire 50 or 66 need not be coaxial with the tubing 70 (although such a coaxial relationship will yield acceptable results), but rather may be generally randomly disposed within the latter and by this feature of the method, manufacturing costs are substantially reduced.

Referring now more particularly to FIGS. 1 through 3, the transformer 30 is employed in the present application as an input transformer to the transistor amplifiers 18 and has the longitudinally axes of the leg stretches 44 thereof extending essentially perpendicular to the board 12, with the extremities 48 being connected as by soldering directly to the circuit paths 28 thereby functioning to directly connect the tubular member 40 which forms the secondary winding thereof to the circuitry while also providing a means for supporting the transformer 30 on the board 12. In operation, heat generated within the tubular member 40 is dissipated away from the interior thereof by virtue of the fact that such heat is conducted throughout the length of the unitary, tubular member 40 and is thus radiated into the atomsphere particularly at the bight portion 42 and the extremities 48. Further cooling of the transformer 30 is acheived by virtue of the cooperative communication of the openings 46 with the openings 52 which allow heat generated within the leg stretches 44 to escape by convection through either or both ends of leg stretches 44.

The input transformer 20 is mounted over a cutout portion 82 in the board 12, which cut-out portion 82 is generally rectangular in shape and forms air cooling passageways 83 through the board 12. The longitudinal dimension of the cutout portion 82 is chosen to be essentially co-extensive with the leg stretches 58, the latter extending somewhat into the cutout portion 82 and suspended thereabove by virtue of the fact that the extremities 60 and bight portion 56 are secured to the upper planar surface of the board 12. In some high power applications, it may be necesarry to mount a heat sink device 84 on the opposite planar side of the board 12 which may be secured to the latter or to the transformer 20 itself whereby to contact the latter and conduct heat away therefrom through the cutout portion 82 to the opposite side of the board 12 and in fact such heat sink may be extended longitudinally in the direction of the transistors 18 whereby to permit coupling with the latter to provide a common heat sink for the transformer 20 as well as the transistors 18. In operation, the output transformer 20 in combination with the cut-out portion 82 of the circuit board 12 has been found to be a particularly efficient combination for dissipating large quantities of heat generated in coupling power from the transmitter amplifiers to an antenna load in radio frequency circuits with power amplifiers having rated outputs of 300 watts or more. As in the case of input transformer 30, the tubular member 54 of the transformer 20 functions to uniformly distribute and conduct the heat generated within the leg stretches 58 out toward the bight portion 56 and extremities 60. Thus, the bight portion 56, herein employed as a center tap connected to the circuit path 86 also functions as a heat sink to radiate unwanted heat, while the extremities 60 have been elongated and are essentially co-extensive with substantial stretches of the circuit paths 24 in order to increase their ability to conduct heat away from the leg stretches 54 and provide additional surface area exposed to the atmosphere for transferring the heat away therefrom. Also, the openings 62 and 64, which are substantially aligned with the respective longitudinal axes of the leg stretches 58, are in cooperative communication to allow the escape of heat via convection through the opposite ends of the leg stretches 58. Furthermore, the openings 62 and 64 function to isolate those parts of the tubular member 54 which function as a "heat sink," namely extremities 60 and bight portion 56, so that heat present in the latter does not present a resistance to the escape of heat from the ends of the leg stretches 58, the openings 62 and 64 further functioning to permit airflow through the interior of the bight portion 56 and leg stretches 58 themselves to further dissipate heat. Finally, the heat being radiated by the magnetic elements 68 along the leg stretches 58 is drawn by conduction through the cutout portion 82 away from the transformer 20 and into the heat sink device 84, the latter radiating such heat into the atmosphere on the side of the board 12 opposite the transformer 20. It can be appreciated however, in lower power output applications, the heat sink device 84 may not be required in which case sufficient cooling is provided by air currents drawn through the passageways 83 which in turn draw the heat away from the leg stretches 58 by convection.

It will be observed that my improved transformer device not only provides for the reliable accomplishment of the objects of the invention, but does so in an especially simple and economical manner. It is recognized, of course, that those skilled in the art may make various modifications or additions to the embodiments chosen to illustrate the invention without departing from the scope and spirit of my contribution to the art. Accordingly, it is to be understood that the protection sought and to be afforded hereby should be deemed to extend to the subject matter claimed and all equivalents thereof fairly within the scope of the invention.

I claim:

1. An electrical transformer device including:

a first winding comprising a single, unitary, elongate, electrically conductive, tubular member arranged in a generally U-shaped configuration having a bight portion and a pair of legs projecting from said portion, there being a cut-away zone between said portion and each of said legs to provide a first pair of openings in said member thereat, the outer extremities of said legs being adapted for connection to one electrical circuit and functioning to physically support said device on a base surface, said member including a second pair of openings therein respectively in said legs thereof adjacent said extremities of the latter;

magnetic means laterally enveloping central stretches of each said legs; and a second winding comprising an electrically conductive wire element having the length thereof passed through the interior of said tubular member and generally randomly disposed therewithin with respect to the longitudinal axis of the latter, said wire element extending through said second pair of openings and between the latter whereby to place said wire element in inductively coupled relationship to said member, said wire element being electrically insulated from said member and having the opposite extremities thereof respectively adapted to allow connection of said second winding with another electrical circuit.

said first and second pairs of openings being in cooperative communication to allow convection of heat generated within said tubular member to the atmosphere, said leg extremities and said bight portion functioning to conduct heat away from said legs and radiate the same to the atmosphere, whereby to reduce the operating temperature of said device and thereby increase the power coupling capability of said device.

2. The invention of claim 1, wherein:

said extremities of said legs diverge away from said central stretches of said legs and away from each other, and the respective openings of said first and second pairs thereof are substantially aligned with the corresponding longitudinal axes of said tubular member along said central stretches of said legs, said extremities of said wire element being trained through respectively associated ones of said first pair of openings whereby to allow connection of said second winding to said another electrical circuit at a location spaced from the connection of said leg extremities to said one electrical circuit.

3. The invention of claim 2, wherein said length of said wire is passed through said interior of said tubular member a number of times to form a plurality of coil turns, and the lengths of said wire of said coil turns are spirally twisted about each other whereby to provide, balanced, uniform inductive coupling between said first and second windings.

4. A method of making a magnetically sleeved electrical transformer including the steps of:

(a) making a first pair of spaced apart openings in a length of electrically conductive tubing, near central stretches of the latter;

(b) making a second pair of openings in said tubing respectively adjacent the extremities of the latter;

(c) forming said tubing into a generally U-shaped configuration having a bight portion and a pair of leg portions;

(d) sliding a number of magnetic members onto said tubing from an extremity of the latter;

(e) after step (d) above, bending said extremities of said tubing to form one winding; and (f) passing a length of wire through the interior of said tubing to provide another winding.

5. The invention of claim 4, wherein:

step (f) includes the step of making a first pair of incisions on one side of tubing, and step (b) includes the step of making a second pair of incisions on the opposite side of said tubing, step (c) being performed by bending said legs away from respectively associated ones of said first pair of incisions, step (a) being carried out by bending said extremities away from said second pair of incisions.

6. The invention of claim 5, wherein step (f) includes the step of:

training the extremities of said wire out through said first pair of openings to allow connection with an electrical circuit adjacent said bight of said tubing.

7. The invention of claim 4 wherein step (f) is performed after performing step (e).

8. The invention of claim 4 wherein step (f) is successively performed a number of times to provide a plurality of coil turns in said another winding, and further including the step of:

spirally twisting the length of said wire in each of said coil turns about each other.

9. In combination with a radio frequency transmitter circuit:

a generally planar, circuit supporting board having a first set of adjacent circuit connections on one side thereof and having a second set of adjacent circuit connections on said one side but spaced from said first set thereof, said board including cut-out portions forming a passageway extending through opposite planar sides thereof and between said first and second sets of circuit connections; and a radio frequency transformer device mounted on said board between said first and second sets of circuit connections, said device including a first winding comprising a single, unitary, electrically conductive tubular member arrange in a generally U-shaped configuration having a bight portion disposed adjacent said first set of circuit connections and a pair of legs projecting from said bight portion toward said second set of circuit connections generally parallel to said one side of said board and superimposed over said passageway, there being a cut-away zone between said bight portion and each of said legs to provide a first pair of openings in said member thereat, the free, outer extremities of said legs being electrically connected to said second set of circuit connections, said device including a second winding comprising an electrically conductive wire having the length thereof passed through the interior of said member whereby to place said wire in inductively coupled relationship to said member, said wire being electrically insulated from said member and having the opposite extremities thereof respectively trained through said openings in said member and connected with said first set of circuit connections.

10. The invention of claim 9, wherein:

said leg extremities extend over portions of said one side of said board adjacent said passageway and are secured to said board, and said bight portion of said member extends over a portion of said one side of said board adjacent said passageway and is secured to said board, said leg extremities and said bight portion cooperating to mount said transformer device on said board whereby suspend said legs in superimposed relationship over said passageway through said board.

11. The invention of claim 10, wherein there is further provided:

a number of magnetic elements laterally enveloping stretches of said legs, each said magnetic elements having a hole therein adapted to receive one of said legs therethrough, said length of said wire being generally randomly disposed within said tubular member with respect to the longitudinal axis of the latter.

12. The invention of claim 11, wherein:

central stretches of said legs extend essentially parallel to each other, and said leg extremities are divergent away from each other, there being a second pair of openings in said tubular member respectively between said leg extremities and said central stretches of said legs, said first and second pairs of opening cooperating with each other and with said passageway in said board to effect air cooling of said transformer device.

13. The invention of claim 12, wherein said bight is electrically connected to said first set of circuit connections whereby to provide a center electrical tap of said first winding.

14. The invention of claim 9 wherein said length of said wire is passed through said tubular member a number of times to form a plurality of coil turns, and the lengths of said wire of said coil turns are spirally twisted about each other whereby to provide balanced, uniform inductive coupling between said first and second windings.

* * * * *